United States Patent [19]

Hicks et al.

[11] 4,099,330

[45] Jul. 11, 1978

[54] VIBRATORY DRAWING DEVICE

[75] Inventors: Alan A. Hicks, Chicago; Derek A. Brand, Naperville; Howard J. Morrison, Deerfield, all of Ill.

[73] Assignee: Marvin Glass & Associates, Chicago, Ill.

[21] Appl. No.: 767,398

[22] Filed: Feb. 14, 1977

[51] Int. Cl.[2] ..... B43L 13/00

[52] U.S. Cl. ..... 33/18 R; 33/32 F

[58] Field of Search ..... 33/18 R, 27 L, 27 R, 33/32 D, 32 E, 32 F, 32 R, 32 G, 26

[56] References Cited

U.S. PATENT DOCUMENTS

| | | | |
|---|---|---|---|
| 2,721,389 | 10/1955 | Sayce | 33/32 D |
| 3,416,231 | 12/1968 | Mercorelli | 33/18 R |
| 3,848,564 | 11/1974 | Kull | 33/18 R |

*Primary Examiner*—Richard E. Aegerter

*Assistant Examiner*—John W. Shepperd

*Attorney, Agent, or Firm*—Mason, Kolehmainen, Rathburn & Wyss

[57] ABSTRACT

An apparatus for creating designs on a substrate such as a sheet of paper includes a frame with a platen mounted on the top thereof. The platen is loosely mounted for vibratory movement relative to the frame. A drive cam, through a link system, is connected to the platen to slowly move the platen in one direction and then rapidly move the platen in a directly opposite direction. A writing implement, such as a pen or pencil, is mounted in a generally vertical position on the substrate on top of the platen, to move with the platen as it is driven slowly in a first direction and then to move relative to the platen as it rapidly returns. The link means is selectively manually rotatable to permit changing the orientation of the vibratory movement of the platen and substrate.

13 Claims, 6 Drawing Figures

VIBRATORY DRAWING DEVICE

BACKGROUND OF THE INVENTION

1. Field of the Invention

This invention relates particularly to vibratory mechanical drawing devices.

2. Brief Description of the Prior Art

In the past, many mechanical devices have been successfully manufactured to facilitate the construction of various creative designs. One such device includes a plurality of interrelated gear portions which facilitate the construction of various geometric designs. All of the prior art drawing devices utilize specific manually movable elements to control the operation of the various components.

SUMMARY OF THE INVENTION

An object of the present invention is to provide a new and improved drawing device.

In accordance with the above and other objects, the present invention provides an apparatus for creating designs on a substrate such as a sheet of paper including a frame having a platen mounted on the top thereof. The platen is loosely mounted for vibratory movement relative to the frame. A drive cam, through a link system, is connected to the platen to slowly move the platen in one direction and then rapidly move the platen in a directly opposite direction. A writing implement, such as a pen or pencil, is mounted in a generally vertical position on the substrate on top of the platen, to move with the platen as it is driven slowly in a first direction and then to move relative to the platen as it rapidly returns. The link means is selectively manually rotatable to permit changing the orientation of the vibratory movement of the platen and substrate.

Other objects, features and advantages of the invention will be apparent from the following detailed description taken in connection with the accompanying drawings.

DESCRIPTION OF THE PREFERRED EMBODIMENT

Figure 1:
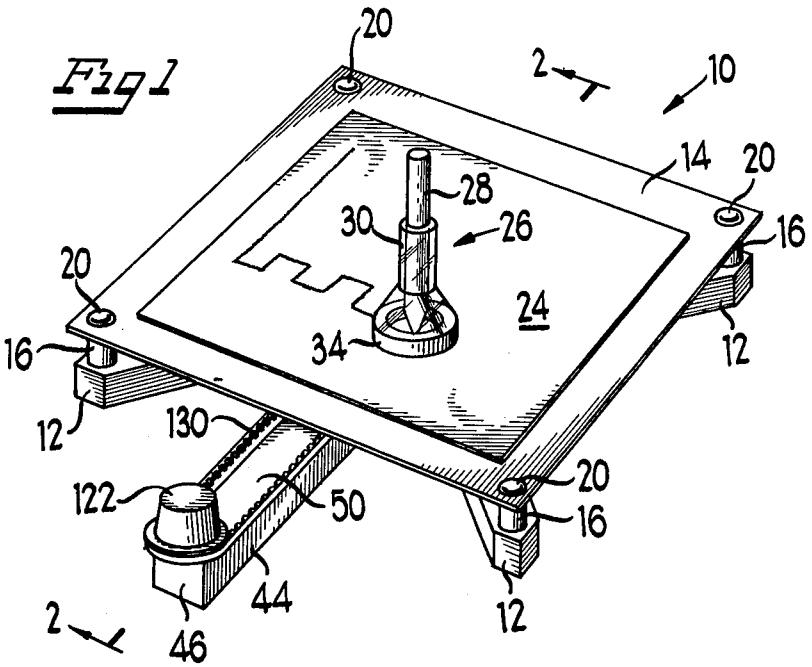
FIG. 1 is a perspective view of the apparatus made in accordance with the concepts of the present invention.
Figure 3:
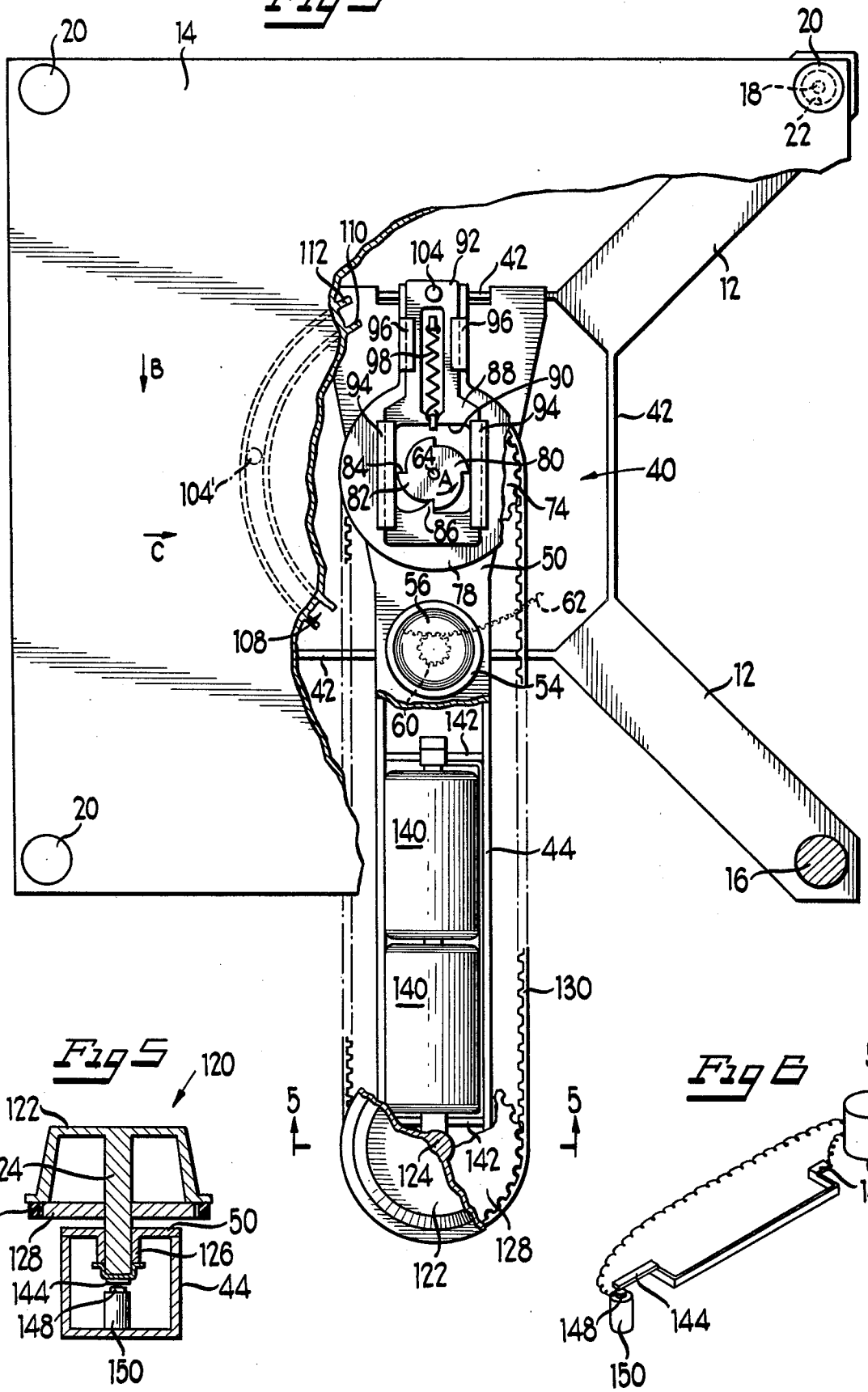
FIG. 3 is a partially fragmented, top plan view, on an enlarged scale, of the drawing device of FIG. 1.

A drawing device, generally designated 10, made in accordance with the concepts of the present invention, is shown in FIG. 1. The drawing device 10 includes a generally X-shaped frame having four radially directed legs 12 (FIGS. 1 and 3). A movable platen 14 is mounted on the frame by a mounting post 16 at the end of each leg. A small diameter upstanding pin 18 is mounted on each post having a cap or crown portion 20 thereon. The platen 14 includes four apertures 22 generally at each corner thereof which mounts the platen on the pins 18. The apertures 22 are smaller in diameter than the post 16 to prevent movement of the platen 14 out of its predetermined plane.

A substrate, such a sheet of paper 24, is positioned on the platen 14 prior to use and secured thereto with adhesive, or other suitable attachment means to maintain the substrate 24 in engagement with the platen 14 for movement therewith. A writing implement, generally designated 26, is placed on the substrate 24 for free movement thereover. The writing implement includes a central core 28 such as a pencil or felt tip pen which is maintained in a normal relationship with the platen and substrate by a clear plastic frame 30 which is supported at its lower flared end by an annular ring 34. The annular ring 34 may be made of any suitable material so as not to mar or mark the substrate 24. Thus, the tip of the pencil 28 is free to construct lines on a substrate 24 due to the influence of gravity, as the writing implement 26 moves relative to the substrate 24. In the preferred embodiment, the writing implement 26 includes a substantial mass so that, as will be described in greater detail hereinafter, rapid movement of the platen 14 in one direction will cause the pencil 28 to construct a line on a substrate 24 as the mass of the implement 26 maintains the pencil 28 substantially in one position during said movement.

Figure 4:
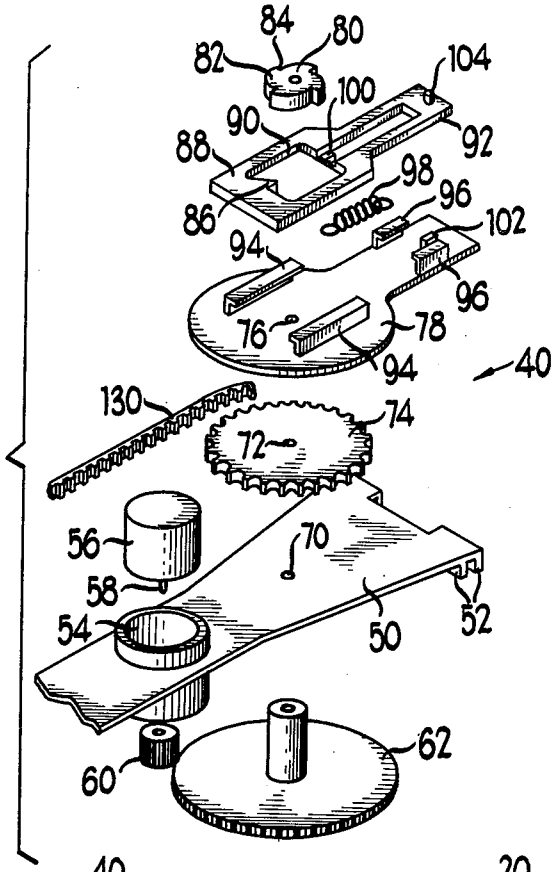
FIG. 4 is a partially fragmented, exploded perspective view of the drive means of the drawing device of the present invention.
Figure 2:
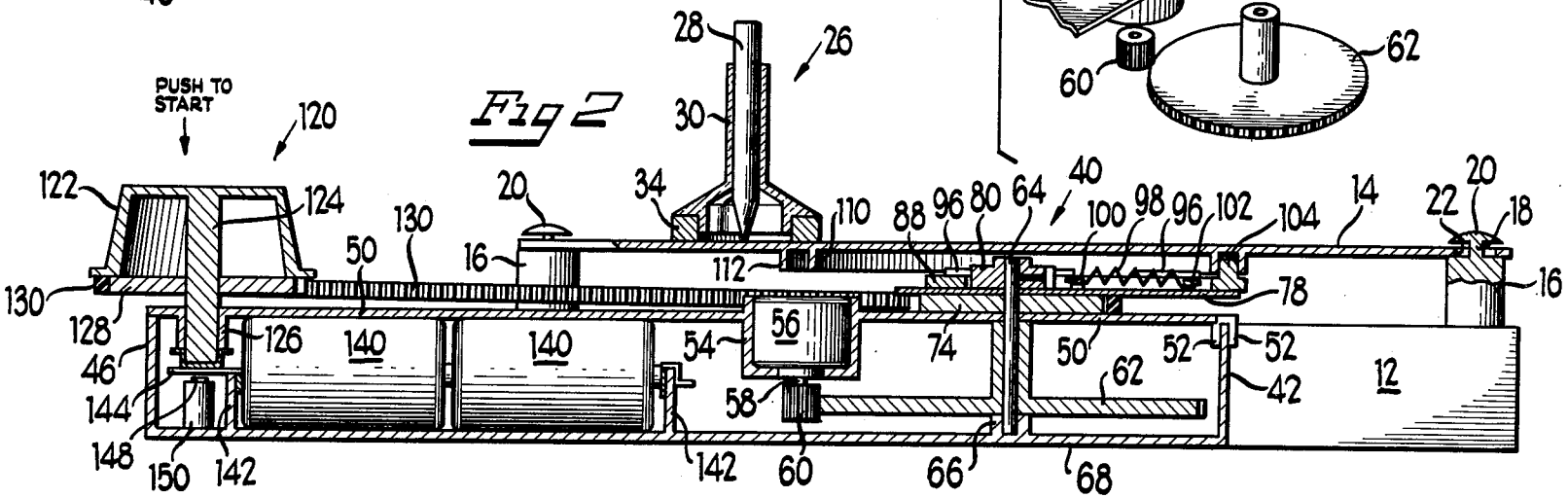
FIG. 2 is a vertical section, on an enlarged scale, of the drawing device of FIG. 1, taken generally along line 2—2 of FIG. 1.

The drawing device 10 includes a drive means generally designated 40 which causes movement of the platen 14 to construct various designs. More particularly, the drive means 40 is mounted at the center of the base within a generally rectangular housing defined by four vertical walls 42. An elongated generally rectangular extension 44 is secured to one of the walls 42 so that its exposed end 46 is disposed substantially outwardly of the edge of the platen 14. The extended portion 44 includes a top wall 50 which extends inwardly across the generally open top of the housing for securement to the opposite wall 42 by a pair of depending flanges 52 as best seen in FIG. 2. The top wall 50, referring to FIGS. 2 and 3, includes an integrally mounted generally cylindrical cavity 54 which mounts an electric motor 56 with its shaft 58 extending downwardly to mount a pinion gear 60. The pinion gear 60 engages a large stepdown gear 62 which is mounted at its bottom end by a journal 66 mounted within the bottom wall 68. The upper end of the shaft 64, referring to FIG. 4, extends through an aperture 70 in the wall 50, through an aperture 72 in a timing gear 74, through an aperture 76 in a connecting link mounting plate 78 and within a cam 80 as shown assembled in FIG. 2. The shaft 64 is freely rotatable in all of the apertures 70, 72 and 76 but is connected securely to the cam 80 for rotation thereof.

Referring to FIG. 3, the cam 80 includes four arcuate lobes 82, each of which terminates in a generally radially directed surface 84. A complementary shaped cam follower 86 is provided on a connecting link 88. The connecting link 88 is generally flat having a large rectangular opening 90 for the cam 80 and an elongated end portion 92. The connecting link is slidably mounted for reciprocal movement on top of the connecting link mounting plate by a plurality of upstanding, generally L-shaped flanges 94 and 96. Biasing means in the form of a spring 98 is secured between a tab 100 on the connecting link and a second tab 102 on the connecting link mounting plate to maintain the cam follower 86 in engagement with the surfaces of the cam 80. An upstanding control pin 104 is mounted on the end of the extended portion 92 of the connecting link for transmitting the vibratory motion from the cam 80 to the platen 14. The platen 14 includes a downwardly directed trough 108 formed by a pair of short cylindrical flanges 110 and 112. The upstanding pin 104 rides within the trough 108 and thus transmits the motion of the connecting link, as driven by the cam 80, to the platen 14.

In operation, the movement of the platen 14 as generated by the cam 80, causes the writing implement 26 to construct lines on the substrate 24. More particularly, referring to FIG. 3, the cam is rotated in a generally counterclockwise direction as shown by arrow A which slowly moves the connecting link and through the pin 104 and trough 108, in the direction of arrow B. This slow movement of the platen causes the writing implement to move with the substrate in the same direction. However, after approximately 90° of rotation of the cam as shown in FIG. 3, the follower 86 reaches a radial surface 84 and rapidly moves inwardly toward the lower point on the cam with rapidly moves the connecting link 88 and thus the platen 14 in a direction opposite that of arrow B. The rapid movement of the platen 14 in the opposite direction causes the writing implement 26, because of its mass and inertia, to remain in a substantially stationary position and thus, the substrate 24 is moved relative to the tip of the pencil 28 and a line is constructed in the direction of arrow B. The length of the line constructed is approximately equal to the radial length of the surface 84 and accumulates with continued rotation of the cam 80 to construct a continuous line.

Figure 5:
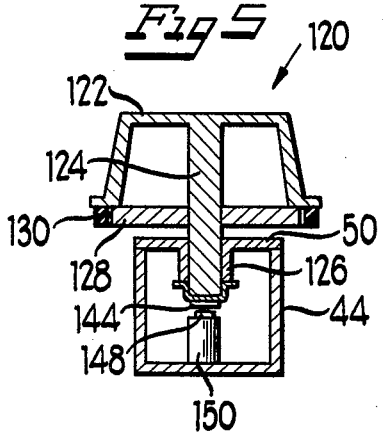
FIG. 5 is a vertical section of the selectively operable actuator, taken generally along line 5—5 of FIG. 3.

The orientation of the direction of movement of the platen with respect to the frame is variable, and controlled by an actuator, generally designated 120 (FIGS. 2 and 5). More particularly, the actuator 120 includes a hand graspable knob 122 which is rotatably mounted by its shaft 124 within a suitable journal 126 formed in the top wall 50. A second timing gear 128 is secured to the bottom of the control knob 120 and is connected to the first timing gear 74 by an endless, toothed timing belt 130. The first or inner timing gear 74 is secured to the bottom of the connecting link mounting plate 78 for conjoint rotation therewith. Thus, as the knob 122 is rotated, the timing gear 74 and connecting link mounting plate 78 rotate in a similar direction and, at a one-to-one ratio. Therefore, the connecting link and pin 104 on the end thereof rotate in the same direction within the trough 108 so that, for example referring to FIG. 3, if the control knob 122 will rotate at 90° in a counterclockwise direction, the control pin 104 would move to a position shown at 104′ 90° relative to its starting position. When in this second position, the movement of the platen would be changed so that during the slow movement caused by the arcuate cam surface, the platen would move in the direction as shown by arrow C in FIG. 3 and then, as the radial surface 84 is reached on the cam, rapidly in a direction opposite that shown by arrow C to construct a line in the direction of arrow C. Thus, by simple rotation of the knob 122, the direction and propagation of the line being drawn can be continuously and variably changed to draw straight and curved lines in any directions to permit the construction of any type or creative and artistic design.

Figure 6:
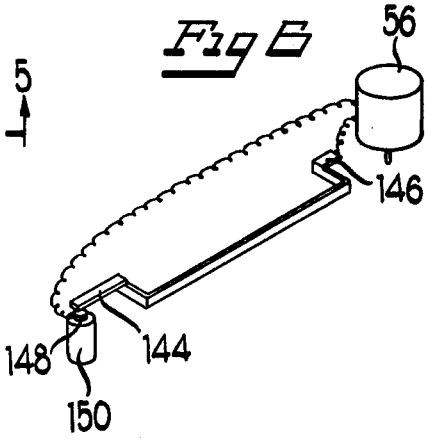
FIG. 6 is a somewhat schematic representation of the electrical circuit of the present invention.

The drive means 40 and particularly the motor 56 is energized by a pair of batteries 40 mounted on the interior of the extension 44 by a pair of flanges 142 at the ends thereof. A flexible terminal 144 at the outer end of the battery housing provides a switch for selective operation or energization of the motor 56. Referring to FIG. 6, the opposite terminal of the batteries 140 is connected to the motor and the other motor terminal is connected to a contact 148 on the top of an upstanding post 150 directly below the flexible contact 144. The switch comprising the contacts 144 and 148 is normally open and biases the control knob 122 in an upward direction through the shaft 124. Therefore, to energize the motor 56 and utilize the drawings device 10, the operator merely depresses the control knob 122 as indicated in FIG. 2 and maintains the switch closed while controlling the direction of movement of the writing implement 26 by selective rotation of the control knob 122. Thus, it can be seen that any types of curved, straight or combined lines can be constructed at any angle on the substrate 24 merely by energization of the drive means and selective rotation of the control knob 122.

The foregoing detailed description has been given for clearness of understanding only and no unnecessary limitations should be understood therefrom as some modifications will be obvious to those skilled in the art.

We claim:

1. An apparatus for creating designs on a substrate, comprising, in combination:
   - a frame structure;
   - a platen movably mounted on a frame for supporting a substrate;
   - means for moving said platen relative to the frame structure in a first direction at a predetermined rate and in an opposite direction in a substantially greater relative rate; and
   - a marking device of predetermined mass positionable on said platen and engageable with said substrate for movement therewith at said predetermined rate and for movement relative thereto in response to movement of the platen at said greater relative rate for creating designs on the substrate by movement of said marking device over the substrate.

2. The apparatus of claim 1 wherein said platen moving means includes a driven cam and link means connected between said platen and said cam means, said link means including a cam follower connected to said platen for engagement with the cam to move the platen at said rates.

3. The apparatus of claim 1 including means for selectively varying said first direction with respect to said frame.

4. The apparatus of claim 3 wherein said direction control means comprises a platen drive means connected to said platen for moving the same and means for rotatably mounting said platen drive means.

5. The apparatus of claim 4 wherein said drive means includes a driven cam and link means including a rotatably mounted cam follower, in engagement with said driven cam, connected to said platen to vary the orientation of said first direction with respect to said frame to control the direction of movement of said marking device with respect to the platen.

6. The apparatus of claim 5 wherein said link means is slidably connected to said platen by a generally circular trough.

7. The apparatus of claim 6 including a manually operable actuator connected to said link means to selectively control the rotary position of said link means.

8. The apparatus of claim 7 wherein said actuator includes means for selectively energizing said drive means.

9. The apparatus of claim 8 wherein said link means and said actuator are connected to one another by a timing belt so as to rotate in a one-to-one relationship.

10. The apparatus of claim 8 wherein said link means includes a rotatable plate connected to said actuator, a cam follower plate relatively movable with respect to said rotatable plate, and means for biasing said cam plate in a direction so as to maintain the cam follower in engagement with said cam means.

11. The apparatus of claim 10 wherein said driven cam includes a multi-lobed cam having at least one generally radial directed surface to provide movement of the platen in a direction opposite said first direction at a substantially greater relative rate.

12. The apparatus of claim 1 wherein said platen is mounted on the frame by a plurality of pins, said platen including substantially larger apertures for mounting on said pins, to permit relative movement between the platen and the pins.

13. An apparatus for creating designs on a substrate, comprising:

a frame structure;

a platen for supporting a substrate;

means mounting the platen for movement relative to the frame;

a cam rotatably mounted on said frame;

drive means for rotating the cam at a predetermined rate of rotation;

link means including a cam follower between said cam and said movable platen for moving the platen in a first direction at a predetermined rate and for moving the platen in a direction generally opposite said first direction at a substantially greater relative rate in response to rotation of said cam by the drive means;

means mounting said link means for rotation with respect to said frame to selectively vary the orientation of said first direction with respect to said frame; and a writing implement, said writing implement being positionable on said platen for engagement with said substrate and for movement therewith at said predetermined rate and for movement relative thereto in response to movement of said substrate at said greater relative rate for creating designs thereon by movement of said writing implement thereover.

* * * * *